US005281333A

United States Patent [19]

Bernhardt

[11] Patent Number: 5,281,333

[45] Date of Patent: Jan. 25, 1994

[54] ARRANGEMENT FOR CLEANING GROUND WATER

[75] Inventor: Bruno Bernhardt, Reutlingen, Fed. Rep. of Germany

[73] Assignee: IEG Industrie-Engineering GmbH, Betzingen, Fed. Rep. of Germany

[21] Appl. No.: 14,394

[22] Filed: Feb. 5, 1993

[30] Foreign Application Priority Data

Feb. 6, 1992 [DE] Fed. Rep. of Germany ..... 4203382
Oct. 17, 1992 [DE] Fed. Rep. of Germany ..... 4235069

[51] Int. Cl.[5] ..... C02F 1/00; B01D 24/04

[52] U.S. Cl. ..... 210/170; 210/196; 210/287; 210/459; 166/67; 166/311

[58] Field of Search ..... 210/170, 196, 287, 264, 210/218, 747, 901, 258, 457, 459; 166/51, 67, 265, 276, 278, 311

[56] References Cited

U.S. PATENT DOCUMENTS

| | | | |
|---|---|---|---|
| 4,543,186 | 9/1985 | Weisenberger et al. | 210/170 |
| 5,015,370 | 5/1991 | Fricano | 210/170 |
| 5,082,053 | 1/1992 | Bernhardt | 166/311 |
| 5,095,975 | 7/1992 | Bernhardt | 166/67 |
| 5,116,163 | 5/1992 | Bernhardt | 210/170 |
| 5,143,606 | 9/1992 | Bernhardt | 210/170 |
| 5,143,607 | 9/1992 | Bernhardt | 210/170 |
| 5,171,104 | 12/1992 | Bernhardt | 405/128 |
| 5,220,958 | 6/1993 | Bernhardt | 210/170 |

FOREIGN PATENT DOCUMENTS

| | | |
|---|---|---|
| 3842740 | 6/1990 | Fed. Rep. of Germany . |
| 4001011 | 12/1990 | Fed. Rep. of Germany . |

*Primary Examiner*—Christopher Upton
*Attorney, Agent, or Firm*—Michael J. Striker

[57] ABSTRACT

An arrangement for cleaning ground water and ground region through which it passes comprises transporting unit for producing a liquid circulation between a well shaft extending in the region of contaminated ground water and the surrounding region, unit for separating the well shaft into an upper region and a lower region, a water permeable shaft wall arranged at least locally for aspiration of water from and reintroduction of water into the ground, unit for connecting the regions with one another and including a throughgoing tube in which the transporting unit operate, and unit forming filter chambers in the upper region and in the lower region of the well shaft. The filter chambers occupy the whole free cross-section of the well shaft and extend at least in the upper well region upwardly over an upper edge of the water permeable shaft wall into an outwardly closed shaft region.

24 Claims, 6 Drawing Sheets

ARRANGEMENT FOR CLEANING GROUND WATER

BACKGROUND OF THE INVENTION

The present invention relates to an arrangement for cleaning ground water and a ground region through which the ground water passes.

More particularly, it relates to an arrangement of the above mentioned general type which has a transporting device for producing a liquid circulation guided through a filter, between a well shaft extending to the region of the ground water to be cleaned and the surrounding ground region. The well shaft is subdivided into an upper and a lower region which are separated from one another and has at least locally a water permeable shaft wall for aspiration of water from and then introduction of water into the ground region, and a throughgoing pipe connecting the regions with one another and accommodating the transporting device.

An arrangement of the above mentioned general type is disclosed, for example in the German reference DE-PS 4,001,011. With this arrangement there is a problem that the filter regions formed along the well shaft wall, for example filter gravel filler arranged in the well pipe, are not available for cleaning, deposits can form there, and therefore the efficiency of the arrangement is undesirably affected. Moreover, an outer filter gravel casing requires a greater opening diameter, which makes the arrangement more expensive. It has been recognized that the filter layers which are arranged before the water permeable vertical shaft wall regions are contaminated fast and these deposits can be removed, due to the vertical position of the filter surfaces, only with great expenses with use of acids and a cleaning circulation with water under high pressure.

SUMMARY OF THE INVENTION

Accordingly, it is an object of the present invention to provide an arrangement of the above mentioned general type which avoids the disadvantages of the prior art.

More particularly, it is an object of the present invention to provide an arrangement of the above mentioned type which ensures a favorable use of a well shaft cross-section without danger to the efficiency and service life of the cleaning well.

In keeping with these objects and with others which will become apparent hereinafter, one feature of the present invention resides, briefly stated, in an arrangement in which both in the upper as well as in the lower region of the well shaft filter chambers are formed, the filter chambers occupy the whole free bore cross-section of the well shaft and at least in the upper well shaft region extend upwardly over the upper edge of the water permeable shaft wall into an outwardly closed shaft region (well tube). Advantageously in one or both shaft regions several filter chambers can be arranged one above the other and separated from one another by a sieve wall.

In the inventive arrangement all filter regions are arranged inside a bore cross-section of the well shaft and extend over the whole bore cross-section while it is not taken by another part of the arrangement, in particular by the mainly centrally arranged throughgoing tube.

An outer filter casing which requires a greater bore diameter and can be subsequently desirably affected, is dispensed with together with filter walls with vertical filter surfaces which are clogged fast by precipitations from the ground water. Horizontal or inclined filter walls which are provided between several filter chambers are less prone to danger since they become tight. The arrangement of several filter chambers over one another has in addition the advantage: at least the uppermost filter chamber in the well shaft can be provided with exchangeable filter material which can be aspirated or flown in, as for example disclosed in the German document DE-PS 4,138,414 of the applicant.

While in accordance with the present invention the filter regions extend through the whole free bore cross-section, still in the inventive arrangement there is a relatively great free flow space for the ground water inside the well shaft. For example, the sieve walls which limit the filter chamber can be formed as rings which concentrically surround the centrally arranged throughgoing pipe and arranged in pairs mirror-symmetrically relative to one another so as to contact with their outer edges. It is possible that the inner space of these double-conical structures of filter material remain free, or the filter material can be arranged inside the structure. The remaining space either inside the double-conical structure or outside the same, can be filled with a filter material. The sieve walls which limit the filter chambers can be curved and, for example, can be formed as spherical or spherical-segment shaped wall structures which can also limit filter material-free space for the ground water.

In one of numerous possible embodiments of the inventive arrangement, a drum-shaped filter can be located in the lower shaft region before the end of the throughgoing tube. For maintaining small the vertically oriented side walls, the height of the drum body can be relatively small, so that the main filter surfaces are formed by both horizontal end surfaces of the drum.

The transporting device of the inventive arrangement can be for example at least one feed pump, which preferably can be located in the throughgoing tube. Also, in addition to the feed pump or exclusively, the transporting device can be formed by an airlift device which advantageously can be formed as a nozzle body arranged in the upper region of the well shaft. Gas, in particular fresh air, can be supplied from the outside of the well into the airlift device by producing a negative pressure in the upper shaft region. The supplied gas acts for an additional cleaning of the ground water, since during passing through the ground water it takes up volatile impurities and withdraws them. With the concentric guiding rings arranged individually or in groups above the nozzle body, a circulation of the ground water can be forced in the interior of the shaft so as to increase the efficiency of the additional gas treatment of the ground water.

The solution to the above described problems is further improved when the sieve walls which limit at least partially the filter chambers have a special construction, and devices for vibration generators are arranged on the sieve walls and/or in the filtering material of the filter chambers. Preferably the sieve walls can be composed of a supporting and shape-providing web support of round wires which limit sieve openings. The thusly formed sieve openings with round edges reduce the risk of clogging due to deposits. A non-stationary and mobile vibration generator can be arranged on attachments to the web supports and impart from time to time vibrations to the sieve walls. Also a stationary or mobile vibration generator can be formed as mechanically, electromechanically or ultrasound-operated device.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
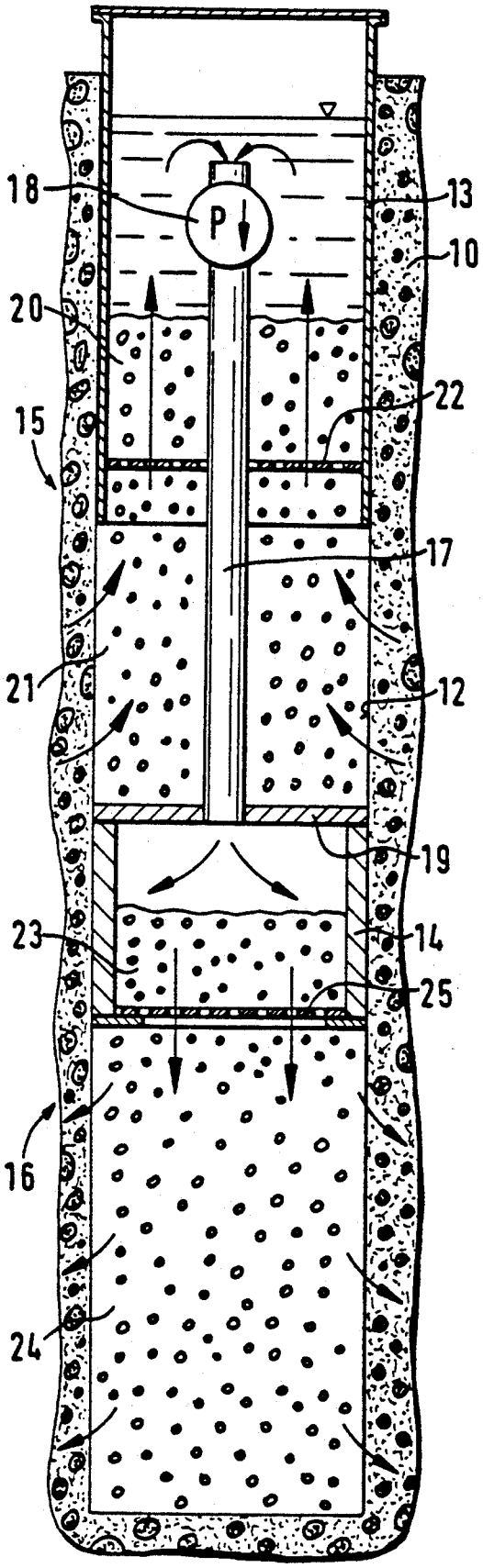
FIGS. 1–4 are views showing schematical longitudinal sections of four arrangement for ground water circulation wells, with several filter chambers in upper and lower well shaft regions and with different designs of the filter chambers.

FIGS. 1 and 4 and 8–11 show bored well shaft which is identified with reference numeral 12 and extends in a ground region 10 through which a ground water to be purified passes. The well shaft 12 is coated in its upper region with a well tube 13. The well shaft is subdivided into an upper region 15 and a lower region 16 by a seal 14. A connection between both regions is performed through a throughgoing tube 17 which is arranged centrally in the well shaft 12. Filter chambers are formed both in the upper and the lower regions 15, 16 of the well shaft 12 and occupy the whole free bore cross-section of the well shaft. The filter chambers are arranged and limited in different ways in different embodiments of the present invention.

In the embodiment of FIG. 1 a pump 18 is arranged in the upper end region of the throughgoing tube 17. It aspirates the ground water which raises in the upper free shaft region surrounded by the well tube 13, into the throughgoing tube 17. The throughgoing tube 17 ends downwardly in an opening of a transverse wall 19 which separates the well shaft into the upper shaft region 18 and the lower shaft region 16. A shield 14 formed as an annular casing is connected with the transverse wall 19. Two filter chambers 20 and 21 are formed in the upper shaft region 15 and separated from one another by a horizontal sieve wall 22. Two filter chambers 23 and 24 are formed in the lower shaft region 16. They are separated from one another by a horizontal sieve wall 25, and the upper filter chamber 23 is located inside the ring-shaped casing 14. In the upper shaft region 15 the upper filter chamber 20 is closed from outside, by the well tube 13. Both upper filter chambers 20 and 23 through which water flows only in a vertical direction are filled with an exchangeable filtering material. Both lower filter chambers 20 and 24 which are open toward the shaft wall are filled for example completely with filter gravel. The exchange of the filtering material from the upper filter chambers 20 and 23 can be performed by aspiration of particulate and swelling material and subsequent lowering of the new filter material into the chambers. After withdrawal of the pump 18 the upper filter chamber 23 of the lower well shaft region 16 is accessible through the throughgoing tube 17 for a not shown suction or flow-in hose.

The ground water circulation well of FIG. 1 is operated in so-called left circulation. The ground water which raises in the upper well shaft region 15 in the filter chamber 21 located there and through the upper filter chamber 20 is supplied through the throughgoing tube 17 into the lower shaft region 16. There it first flows through the upper filter chamber 23 with the exchangeable filter material filling and the sieve wall 25, then it flows into the lower filter chamber 24 and from there back into the ground region. In the well tube 13 further solid filter layers can be arranged in the upper filter chamber 20 in form of removable packing rings which are easily exchangeable.

Figure 2:
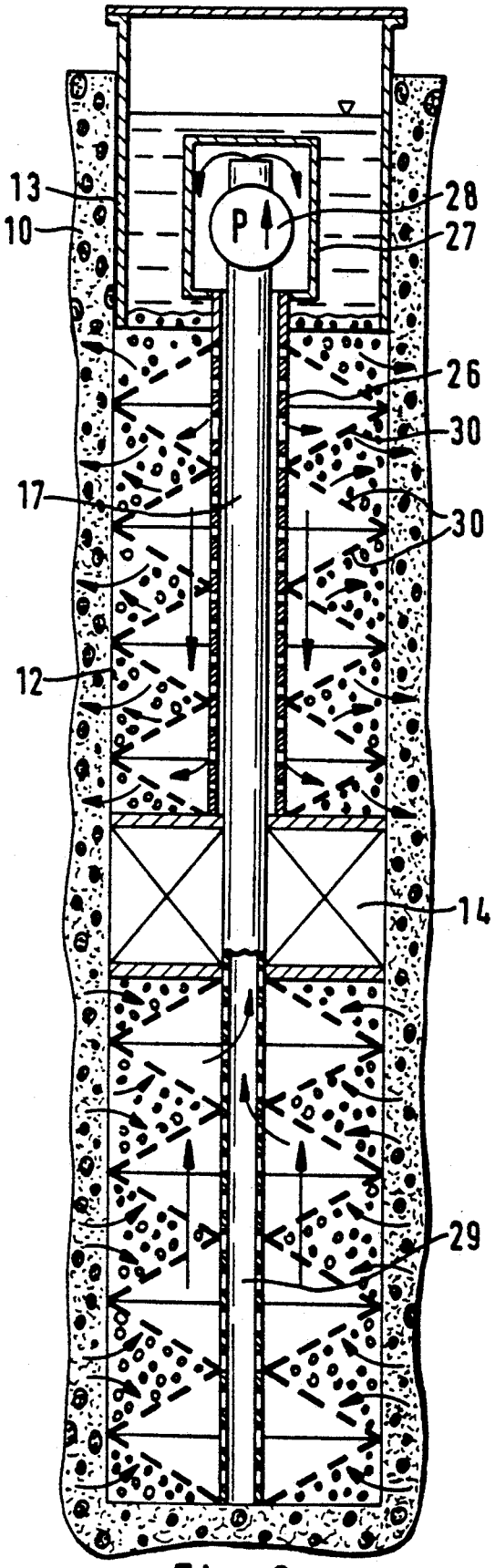

In the embodiment of FIG. 2 a perforated distributor tube 26 of a substantially greater diameter is coaxially arranged over the central throughgoing tube 17 in the upper well shaft region 15. It is expanded in the upper filter-free shaft end to a collecting cylinder 27 in which the throughgoing tube 17 provided with a feed pump 28 ends. The throughgoing tube 17 extends through the seal 14 outwardly to the well shaft bottom in the lower shaft region 16 and is formed with this region as a perforated collecting tube 26. In both well shaft regions 15 and 16 the seal walls 13 limit the filter chambers or the filter regions and are formed as conical rings between the perforated distributing tube 26 and the wall of the well shaft 12. They are arranged in pairs mirror-symmetrically relative to one another and their outer edges contact the sieve walls 30. The inner space of the double conical sieve wall structure forms a free flow space for the ground water. Grain-like filter material abuts against the outer side of the double conical structure. It provides great filter surfaces through which the ground water can be distributed well. The filtering mass which expands from inside outwardly in the individual filter chambers prevents an undesirable vertical ground water flow in the edge region of the well shaft. Exchangeable filter chambers can be dispensed with. The ground water circulation well is operated in a so-called right circulation, or in other words the ground water is aspirated in the lower well shaft region 16, transported upwardly and returned through the upper well shaft region 15 into the ground.

Figure 3:
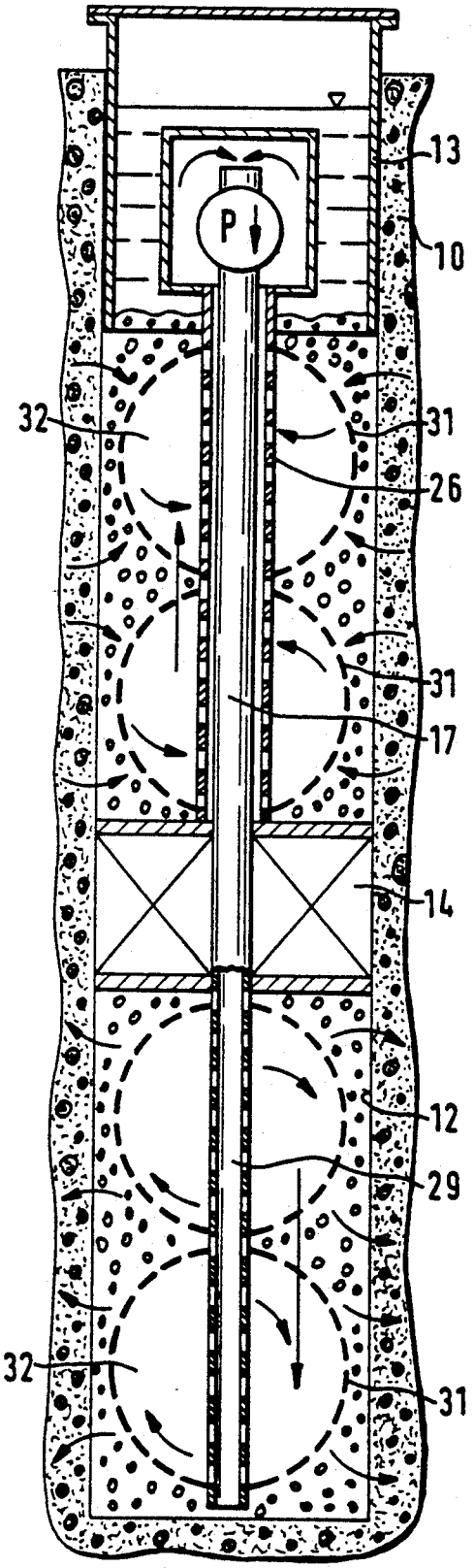
Figure 4:
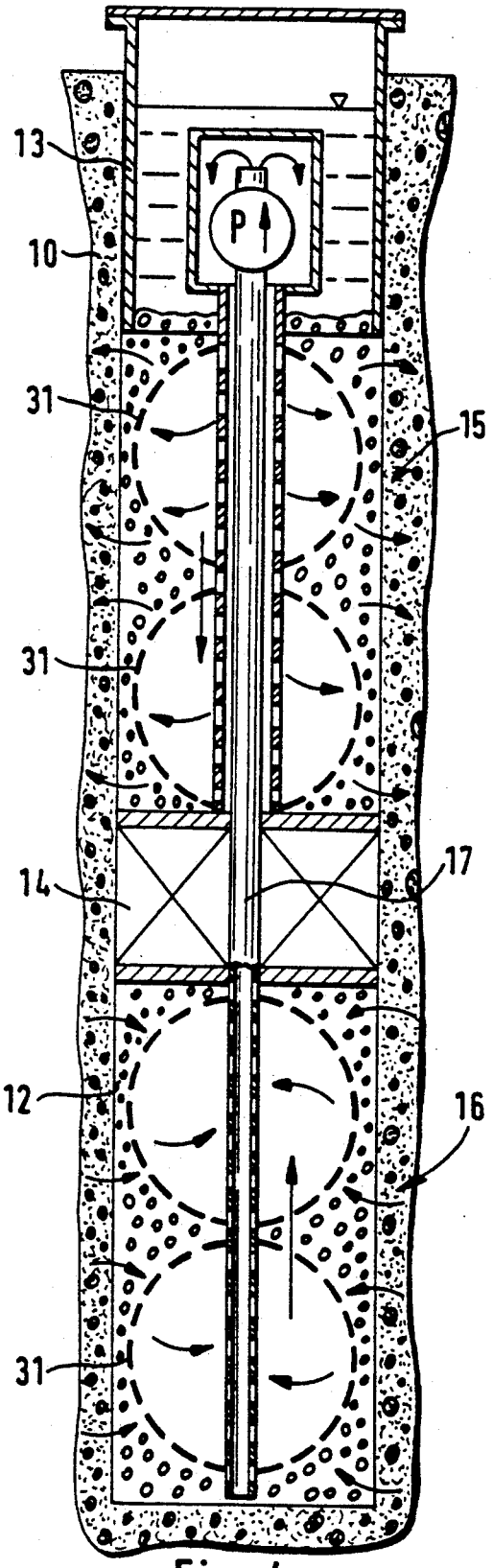

FIGS. 3 and 4 show an arrangement in which in FIG. 3 it operates in the left circulation and in FIG. 4 in the right circulation. In this arrangement both in the upper well tube region 15 and in the lower well tube region 16, outer filter chamber regions are formed with alternating filtering material thicknesses similarly to the embodiment of FIG. 2. Sieve walls 31 which are formed and curved to a torus with a semi-circular cross-section are arranged around the distributing tube 26 and perforated collecting tube 29. The inner space 32 of the torus forms free flow space for the ground water. The space between the outer side of the curved sieve wall 31 and the shaft wall is filled with filter gravel. The ground water circulation well with the left circulation shown in FIG. 3 has the perforated distributing pipe 26 operating as a collecting pipe, while the collecting pipe 29 operates as a distributing pipe.

Figure 5:
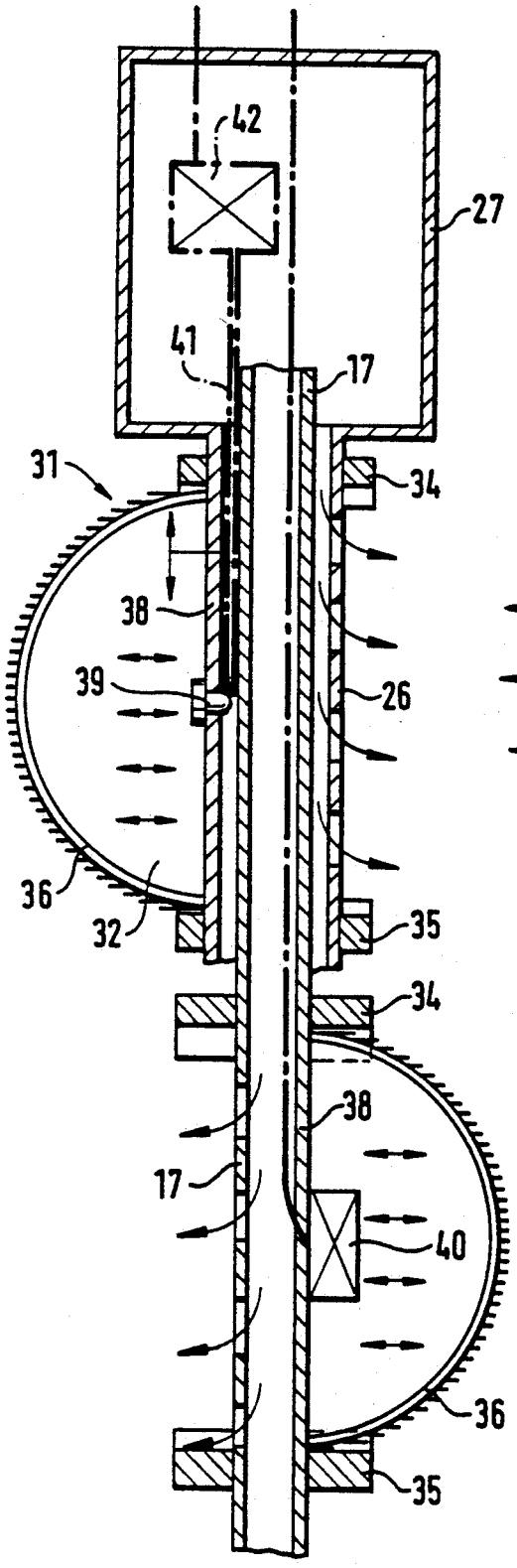
FIGS. 5–7 are views showing an upper part of an arrangement of FIG. 4 with a schematic showing of sieve walls which limit the filter chambers.
Figure 6:
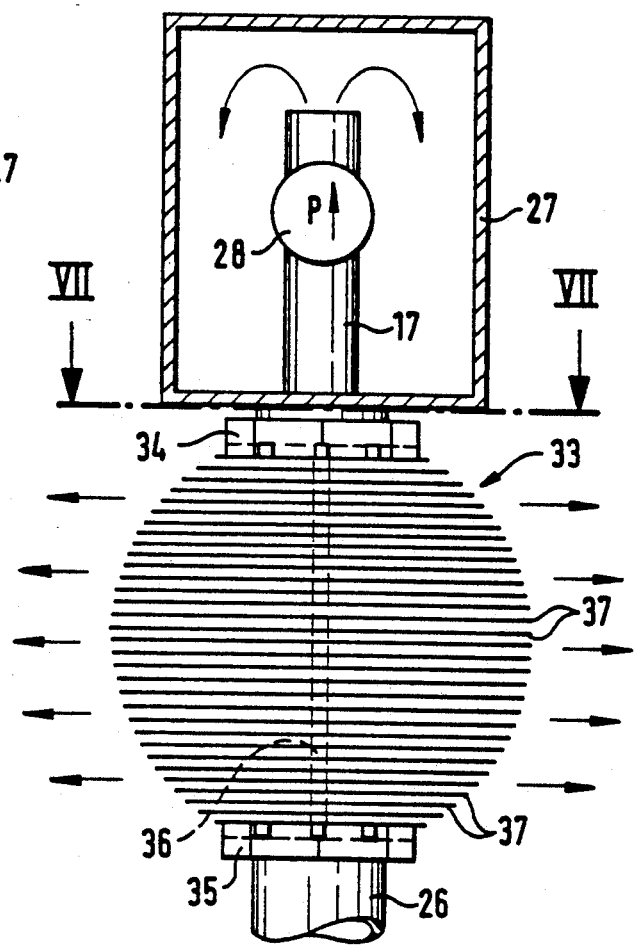
Figure 7:
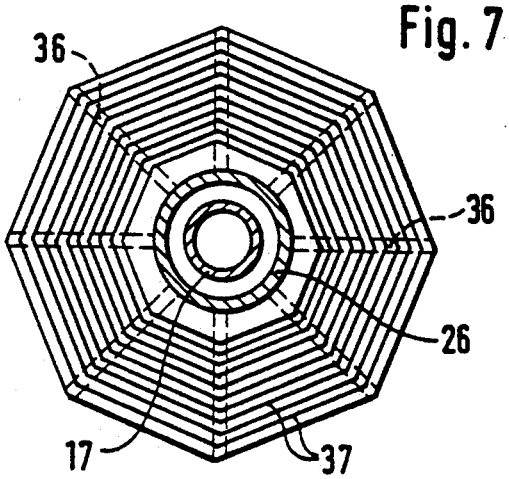

FIGS. 5–7 show in detail the construction of a torus 33 which is formed by a curved sieve wall 31 and fitted on the distributing pipe 26. The web supports 36 are arcuately clamped between two supporting rings 34 and 35. Round wires 37 are arranged on the arcuately clamped web supports 36 at uniform distances. For example they are formed as round wires and connected with the web supports 36 by point welding or glueing. Moreover, both supporting rings 34 and 35 are connected with one another by rectilinear supporting webs 38. At least one of the supporting webs 38 is provided with a cam-shaped projection 39 which extends into the intermediate space between the distributing tube 26 and the throughgoing tube 17 as shown in FIG. 5. The supporting webs 38 can be also connected with one another by an electromagnetically actuatable vibration ring 40 as shown in FIG. 5 as well.

A vibration rod 41 of a mobile vibration generator 42 can be arranged on the projections 39 as shown in FIG. 5 in broken lines. The sieve wall structure can be driven into vibration from time to time by the vibration generators 40 or 42 to loosen the precipitations which deposit on the sieve walls 31 or particles which float from the ground water or the ground.

Figure 8:
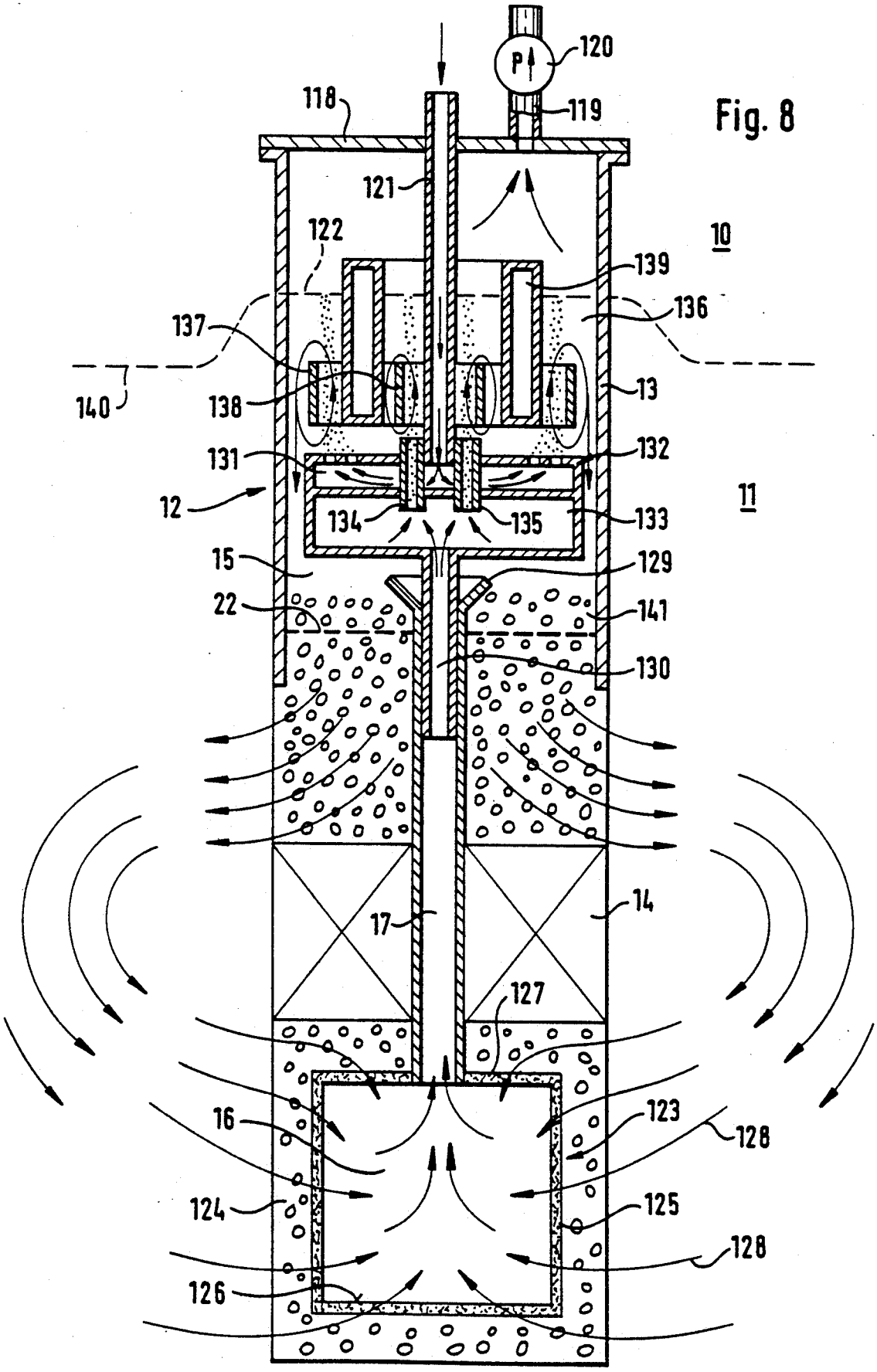
FIGS. 8–11 are more or less schematic longitudinal sections through four arrangements for negative pressure gasified wells.

FIGS. 8–11 show cleaning arrangements in which the ground water is subjected to an additional treatment by gas, particularly air aspirated through the ground water under the action of negative pressure into the upper shaft region in form of fine bubbles. The thusly produced airlift effect provides also a transporting action on the ground water. In the embodiment of FIG. 8 it is a single feed device for forming the ground circulation through the filter chambers of the arrangement.

The well shaft 13 is closed from outside by a cover 118, and an air aspirating tube 119 with a pump 120 and an air aspirating tube 121 pass through the cover. A negative pressure is produced above the ground water level 122 in the shaft 12 by the pump 120. This negative pressure is responsible for transporting the ground water from the lower shaft region 16 into the upper shaft region 13. In the lower shaft region 16 a drum-shaped filter body 123 is arranged and surrounded by filtering gravel 124. The filter body 123 has a vertical side wall 125 and two horizontal filter surfaces 126 and 127 through which the ground water from the surrounding ground region 11 flows under the action of negative pressure in the upper shaft region as identified with the arrow 128. Subsequently water flows through the throughgoing tube 17 into the upper shaft region 15. There it is taken by a second tube 130 inserted in an expansion 128 of the throughgoing tube 17. The tube expands in a cup-shaped manner and forms an air chamber 131 which is limited by a nozzle body 132 and also a water receiving chamber 133 under the air chamber. The water flows from the tube 17 through the insert tube 130 into the water receiving chamber 133 and from there through two tubes 134 and 135 guided through the air chamber 131 into a water treatment region 136 above the air chamber 131. The tubes 134 and 135 have openings at the height of the air chamber 131. Air which is transported by water flowing in the tubes passes into the openings and can be transported upwardly into the treatment chamber 136. Two concentrically arranged guiding rings 137 and 138 are arranged in the treatment chamber 136. They contribute to the laminar flow of the water during flowing upwards and downwards and thereby contribute to the situation that a part of the water flowing downwards is again engaged by the air bubble flow flowing upwards and is cleaned for second time. The air bubbles after reaching the water lever 122 in the well shaft are aspirated by the pump 120, together with the contaminations bound on them, from the shaft. Simultaneously the negative pressure produced in the shaft by the pump 120 operates so that the free air can flow again through the aspiration tube 121 into the air chamber 131.

The whole insert composed of the insert tube 130, the water chamber 133, the air chamber 131, the air supply tube 121 and the guiding rings 137 and 138 is mounted on a float body with air chambers 139 for compensating the fluctuations of the ground water level 140 in the region 11.

After cleaning of the ground water from volatile impurities by the air or gas bubbles in the treatment chamber 136, the ground water flows along the shaft edge downwardly and trickles through a gravel filling 141 in the upper shaft region 15 before leaving the well shaft 12 laterally. During trickling of the water through the gravel filling 141 other substances which are bound in water, such as iron, can be released from water. After the return flow in the ground region 11 the ground water is again engaged by the suction in the shaft region 16 and forms a circulation between the well shaft 12 and the ground region 11. Therefore continuously new not cleaned ground water is pulled in. The range of circulation in the radial direction around the well shaft can be increased by a reduction of the height of the side wall 125 of the drum filter 123 in the lower shaft region.

Figure 9:
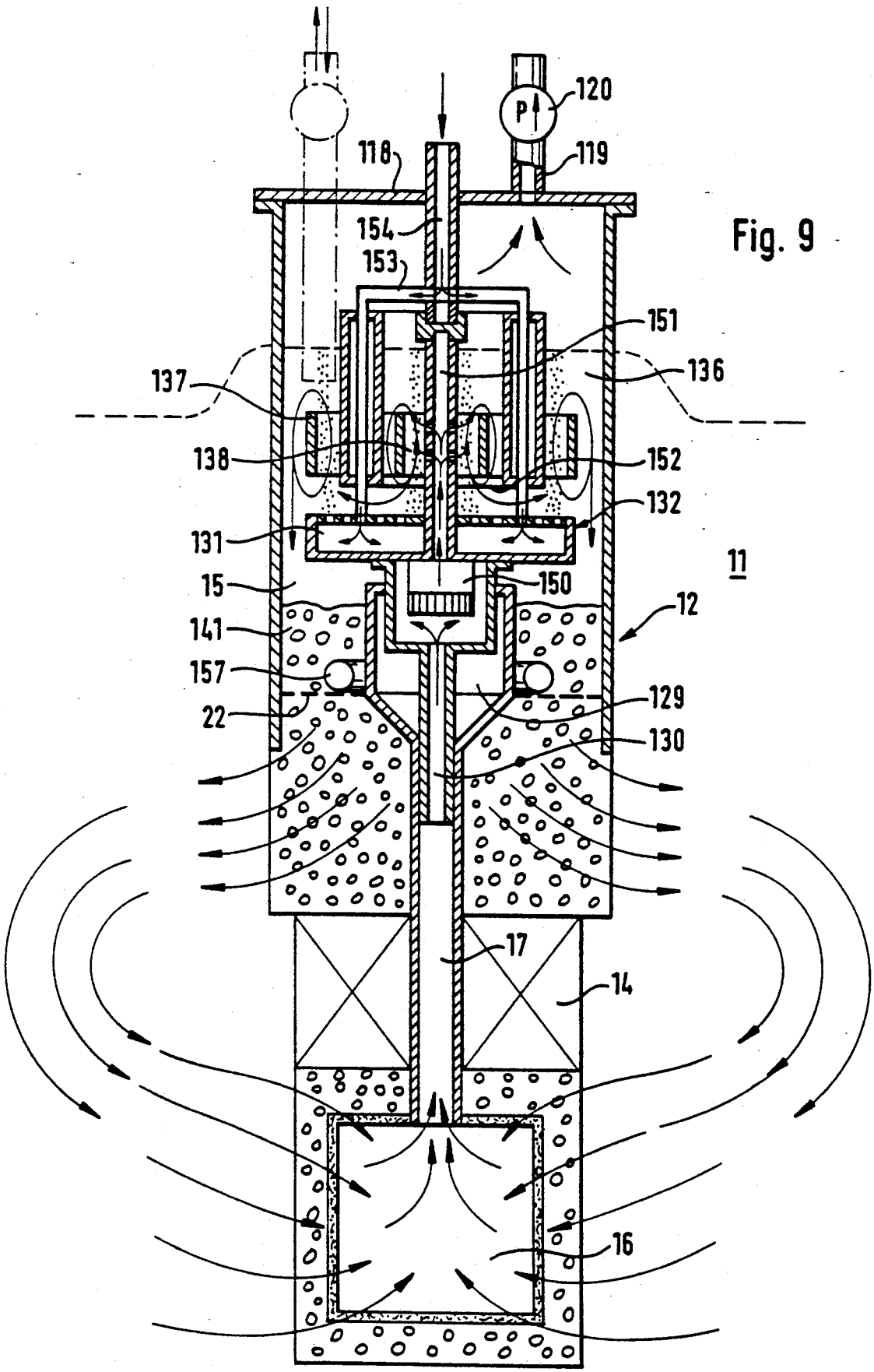

FIG. 9 shows an arrangement in which the lower region 16 has a smaller diameter than the diameter of the upper region 15. In other words expensive wide drilling of the well shaft is required only in the lower region, in which the treatment of the water is performed.

An expansion 29 of the throughgoing tube 17 which connects both shaft regions 15 and 16 with one another, accommodates an insert tube 130 and a feed pump 150 connected with it. A tube 151 is arranged at the output of the pump 150 and transports the water through an air chamber 131 for subsequently discharging through lateral openings 152 into a treatment chamber 136. Two concentric guiding rings 137 and 138 are arranged at the height of the lateral openings 152 for contributing to the laminar water flow.

The tube 151 in its upper region has a transverse wall 153 which prevents penetration of water into an end piece 154 of the tube 151 which extends over the shaft cover 118. The end piece 154 has two connecting tubes 155 and 156 extending to the air receiving chamber 131 for supplying of fresh air into the air chamber 131. Also, in the embodiment of FIG. 8 the fresh air is aspirated in the shaft by means of the negative pressure produced by the pump 120 above the shaft 12.

In the arrangement of FIG. 9 the contaminated ground water is first cleaned in the treatment chamber 135 from volatile impurities before being subjected to a second cleaning during the downward flow through a gravel filling 141. Then the ground water leaves the shaft 12 in the upper region 15 and forms a circulation to the water aspirating point in the lower shaft region 16. The flow speed of the water in the embodiment of FIG. 9 is produced by feed pump 150 and is greater in the embodiment of FIG. 8 where the circulation in the well shaft is produced only by the negative pressure.

A vibration generator 157 is arranged in the gravel filling 141 for cleaning the gravel. Its pressure waves loosen the impurities in the gravel, which subsequently can be aspirated.

Figure 10:
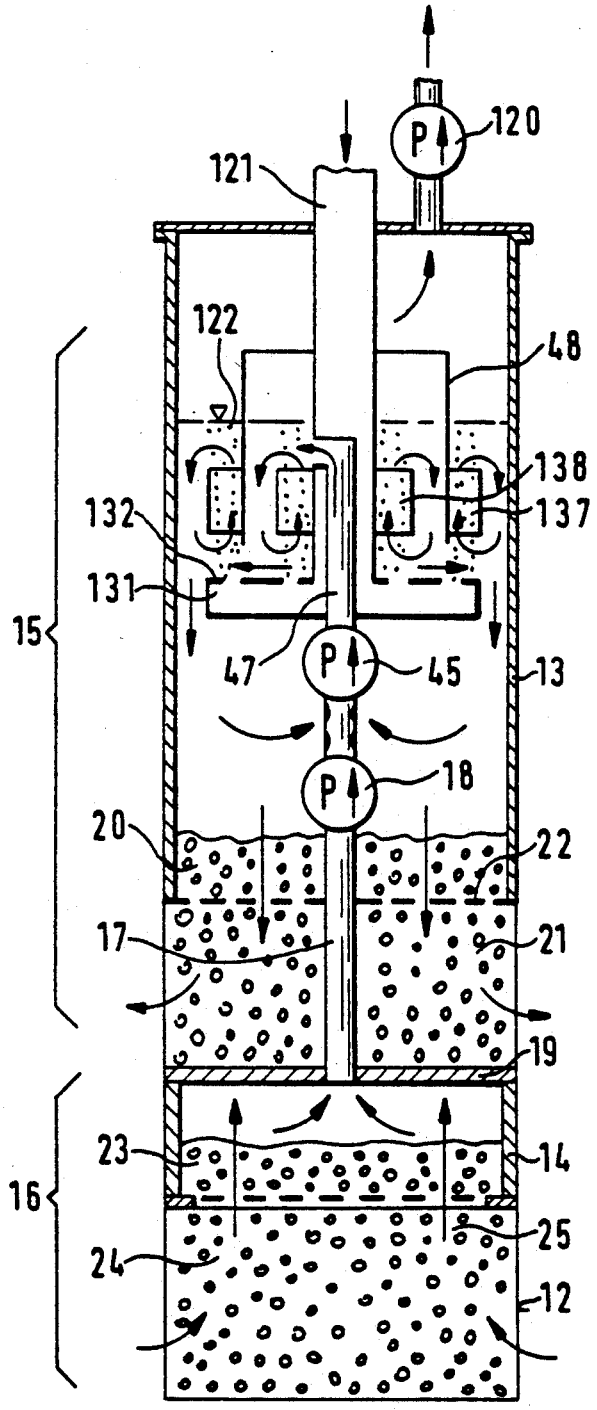
Figure 11:
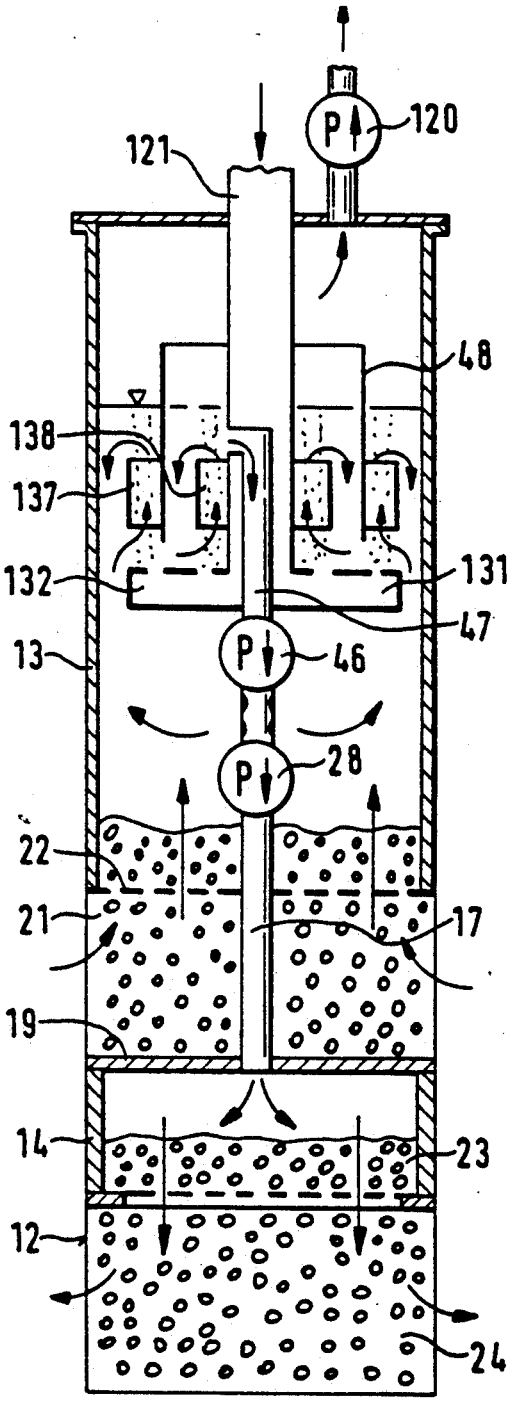

In the embodiments of FIGS. 10 and 11, in addition to the feed pumps 18 and 28 arranged in the throughgoing tube 17, additional feed pumps 45 and 46 are provided.

They intensify and control the ground water movement in the gas treatment region of the arrangement. The construction of the filter part of the arrangement is substantially similar to the construction of the embodiment of FIG. 1 and the corresponding parts of the device are identified with the same reference numerals. In the gas treatment region the parts corresponding to the embodiment of FIG. 8 are provided with the same reference numerals. A multiple circulation of the ground water inside the upper shaft region which is closed from outside by the well tube 13 is performed by pumps 18, 45 and 28, 46 in the embodiments of FIGS. 10 and 11. The additional pumps 45 or 46 are arranged in a tube 47 which extends through the air chamber 131 and has a piece extending further through the air aspiration tube 121. It exits under the liquid level 122 and above the guiding ring 138 in a central region of the upper well shaft region. This central region is limited by a guiding tube 48 which extends through the liquid level 122 and acts in the liquid region as a third guiding plate between both other guiding plates 137 and 138. The guiding plates guide and deviate the ground water many times through the region with the raising gas bubbles. In the embodiment of FIG. 10 the ground water is upwardly transported by the pump 45 into the gas treatment region and then flows through the air chamber 131 downwardly back. In the embodiment of FIG. 11 the ground water is aspirated from the gas treatment region by the pump 46 and raises along the air chamber 131 upwardly into the gas treatment region, when it is not engaged by the pump 28 and is aspirated into the lower well shaft region 16 and the filter chambers in it. The pumps can be operated with different feeding outputs depending on the type and nature of the impurities in the ground water.

It will be understood that each of the elements described above, or two or more together, may also find a useful application in other types of constructions differing from the types described above.

While the invention has been illustrated and described as embodied in an arrangement for cleaning ground water, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic o specific aspects of this invention.

What is claimed as new and desired to be protected by Letters Patent is set forth in the appended claims.

I claim:

1. An arrangement for cleaning ground water and ground region through which it passes, comprising transporting means for producing a liquid circulation between a well shaft extending in the region of contaminated ground water and the surrounding region; means for separating the well shaft into an upper region and a lower region; a water permeable shaft wall arranged at least locally for aspiration of water from one region and reintroduction of water into the ground from the other region; means for connecting the regions with one another and including a throughgoing tube in which said transporting means operate; and means forming at least one filter chamber containing filter material in the upper region and at least one filter chamber containing filter material in the lower region of the well shaft, said filter chambers extending across the entire free cross-section of the well shaft and extending at least in the upper well region upwardly over an upper edge of said water permeable shaft wall into an outwardly closed shaft region.

2. An arrangement as defined in claim 1, wherein a plurality of filter chambers are arranged over one another in both shaft regions; and further comprising a sieve walls which separate said filter chambers from one another.

3. An arrangement as defined in claim 2; wherein said sieve walls are formed as conical rings which concentrically surround said centrally arranged throughgoing tube.

4. An arrangement as defined in claim 3, wherein said rings are arranged in pairs mirror-symmetrically, each pair having outer edges which are in contact with one another.

5. An arrangement as defined in claim 3; and wherein the filtering material is located between said sieve walls and said walls so as to leave between neighboring ones of said sieve walls free spaces for the ground water.

6. An arrangement as defined in claim 2; and further comprising means for vibration generation provided on said sieve wall of said filter chambers.

7. An arrangement as defined in claim 2; and further comprising means for vibration generation provided in the filter material of said filter chambers.

8. An arrangement as defined in claim 1, wherein said filter chambers include an uppermost filter chamber with exchangeable filtering material.

9. An arrangement as defined in claim 1; and further comprising sieve walls which limit said filter chambers and are curved.

10. An arrangement as defined in claim 9, wherein said sieve walls are spherical and wherein the filtering material is located between said sieve walls and said shaft walls.

11. An arrangement as defined in claim 9, wherein said sieve walls limit said filter chambers from inside and are spherical segment-shaped.

12. An arrangement as defined in claim 1; and further comprising a drum-shaped filter arranged in the lower shaft region connected to the lower end of said throughgoing tube.

13. An arrangement as defined in claim 12, wherein said drum-shaped filter has side walls with a height which is smaller than a filter diameter.

14. An arrangement as defined in claim 1, wherein said upper shaft region has a greater diameter than said lower shaft region.

15. An arrangement as defined in claim 1, wherein said throughgoing tube has an upper end provided with an expansion.

16. An arrangement as defined in claim 15, wherein said transporting means includes a feed pump arranged in said expansion.

17. An arrangement as defined in claim 1; and further comprising means forming an air chamber in the upper region of the well shaft for supplying gases from outside of the well shaft by producing a negative pressure in the upper shaft region, said air chamber forming means including a nozzle body connected to an air aspirating tube.

18. An arrangement as defined in claim 17; and further comprising at least one concentric guiding ring arranged above said nozzle body.

19. An arrangement as defined in claim 18; and further comprising a float body, said nozzle body and said guiding ring being mounted on said float body.

20. An arrangement as defined in claim 17; and further comprising a plurality of guiding rings arranged concentrically above said nozzle body.

21. An arrangement as defined in claim 17; and further comprising an additional throughgoing tube extending through said nozzle body for the ground water and provided with additional transporting means formed as a feed pump.

22. An arrangement as defined in claim 1, wherein said throughgoing tube extends above said filter chambers of the upper schaft region and is provided with said transporting means formed as a direction reversible feed pump.

23. An arrangement as defined in claim 1; and further comprising sieve walls which limit said filter chambers and composed of supporting and form-providing web supports and round wires which are supported on said web supports and limit sieve openings.

24. An arrangement as defined in claim 23, wherein said web supports are provided with at least one projection; and further comprising means for vibration generation arranged on said projection.

* * * * *